US009214312B2

(12) United States Patent
Freudenberger et al.

(10) Patent No.: US 9,214,312 B2
(45) Date of Patent: Dec. 15, 2015

(54) X-RAY TUBE WITH A BACKSCATTERING ELECTRON TRAP

(75) Inventors: Jörg Freudenberger, Kalchreuth (DE); Lothar Werner, Weiβenohe / Dorfhaus (DE)

(73) Assignee: Siemens Aktiengesellschaft, Munich (DE)

( * ) Notice: Subject to any disclaimer, the term of this patent is extended or adjusted under 35 U.S.C. 154(b) by 277 days.

(21) Appl. No.: 13/496,429

(22) PCT Filed: Sep. 29, 2010

(86) PCT No.: PCT/EP2010/064394
§ 371 (c)(1),
(2), (4) Date: Mar. 15, 2012

(87) PCT Pub. No.: WO2011/039204
PCT Pub. Date: Apr. 7, 2011

(65) Prior Publication Data
US 2012/0170715 A1 Jul. 5, 2012

(30) Foreign Application Priority Data
Sep. 30, 2009 (DE) ..... 10 2009 047 866

(51) Int. Cl.
*H01J 35/16* (2006.01)

(52) U.S. Cl.
CPC ..... *H01J 35/16* (2013.01); *H01J 2235/168* (2013.01)

(58) Field of Classification Search
CPC ..... H01J 2235/168; H01J 35/16
USPC ..... 378/140
See application file for complete search history.

(56) References Cited

U.S. PATENT DOCUMENTS

| | | | | |
|---|---|---|---|---|
| 5,128,977 | A | 7/1992 | Danos | |
| 5,511,104 | A * | 4/1996 | Mueller et al. | 378/138 |
| 5,995,585 | A | 11/1999 | Salason | |
| 6,005,918 | A * | 12/1999 | Harris et al. | 378/140 |
| 7,778,391 | B2 | 8/2010 | Fuerst et al. | |
| 7,839,979 | B2 | 11/2010 | Hauttmann et al. | |
| 2006/0050850 | A1 * | 3/2006 | Andrews et al. | 378/119 |
| 2008/0112538 | A1 | 5/2008 | Rogers | |
| 2009/0028409 | A1 | 1/2009 | Tsukagoshi et al. | |

FOREIGN PATENT DOCUMENTS

| | | | |
|---|---|---|---|
| JP | 11273597 | A * | 10/1999 |
| JP | 2004111336 | A | 4/2004 |
| JP | 2004111336 | A * | 4/2004 |
| JP | 2007059268 | A | 3/2007 |

OTHER PUBLICATIONS

Translation of JP 2004-111336 A published on Apr. 8, 2004.*

* cited by examiner

*Primary Examiner* — Glen Kao
(74) *Attorney, Agent, or Firm* — Schiff Hardin LLP

(57) ABSTRACT

An x-ray tube has a backscatter electron trap to prevent extra focal radiation caused by backscattered electrons from the focal spot from passing through the beam exit window to an exterior of the x-ray tube. The backscatter electron trap has a surface that faces the x-ray beam in the x-ray tube. No portion of that surface is visible both from an arbitrary point in the x-ray beam outside of the x-ray tube and from an arbitrary point at the focal spot.

8 Claims, 4 Drawing Sheets

X-RAY TUBE WITH A BACKSCATTERING ELECTRON TRAP

BACKGROUND OF THE INVENTION

1. Field of the Invention

The invention concerns an x-ray tube of the type having at least one cathode to generate an electron beam, an anode at which the electron beam strikes and there forms a focal spot so that an x-ray beam emanates from the focal spot, an exit window through which the x-ray beam exits from the x-ray tube, and a backscatter electron trap in order to capture electrons backscattering from the anode. The invention also concerns an x-ray device with such an x-ray tube.

2. Description of the Prior Art

An x-ray tube of the above general type is described in United States Patent Application Publication No. 2008/0112538.

An x-ray tube normally has a cathode and an oppositely situated anode that are arranged in a vacuum housing. The cathode has a filament to emit electrons, and the electrons are accelerated in the direction toward the anode by application of a voltage between the anode and the cathode. The electrons strike a region of the anode that is designated as the focal spot, wherein their kinetic energy is transduced into heat and x-ray radiation (primary radiation). The x-ray radiation that is thereby generated exits from the vacuum housing through an exit window in the form of an x-ray beam (usable x-rays). An electron striking the anode experiences scattering processes at the atoms in the anode that both alter its direction of motion and emit energy. If the kinetic energy of the electron drops sufficiently, it is absorbed into the anode.

Such scattered electrons can also exit the anode again, such that a portion of the incident electrons exits the anode surface again. These electrons are designated as backscatter electrons. Some of the backscatter electrons may strike the anode again and some may strike additional components of the x-ray tube and there transduce their energy into radiation or heat. X-ray radiation generated by the backscatter electrons is designated as extrafocal x-ray radiation (extrafocal radiation) because it arises outside of the impact surface of the primary electron beam. A higher proportion of extrafocal radiation produces an increase in the blurriness of the optical focal spot and thus negatively affects the image quality.

Particularly in modern "unipolar" high power x-ray tubes for computed tomography, a backscatter electron trap (BSE trap) is necessary in order to capture the electrons backscattered from the anode. The trap has the primary purpose of capturing the energy stored in these backscatter electrons and thus keeping it away from the anode, since if this energy were absorbed in the anode it would be more difficult to cool. The BSE trap additionally offers the possibility of masking the unwanted extrafocal radiation with absorption filters located as close as possible to the location of generation of the used usable x-ray radiation, thus collimating the useful radiation. However, it is undesirably physically unavoidable that extrafocal radiation arises at the BSE trap upon impact of the electrons. The image quality can be degraded by the extrafocal radiation. Furthermore, the dose exposure of a patient is increased in an x-ray examination.

SUMMARY OF THE INVENTION

An object of the present invention is to provide an arrangement in which the arising extrafocal radiation does not fall in the primary usable x-ray beam emanating from the focal spot on the anode.

According to the invention, the backscatter electron trap is designed so that it has substantially no surface region situated opposite the x-ray beam and facing toward the x-ray beam, at which surface region at least one partial surface region is visible ("seen") both from an arbitrary point in the x-ray beam outside of the x-ray tube and from an arbitrary point of the focal spot.

The invention in particular concerns backscatter electron traps or the region of a backscatter electron trap in a region of the x-ray tube between a plane established by the exit window and a plane parallel to this in which the electron beam lies.

The invention also in particular concerns those backscatter electron traps or that region of backscatter electron traps whose projection in the direction of an electron beam emanating from the cathode coincides with the usable x-ray beam.

Insignificant surface regions—for example at the connecting line between a partial surface region with the cited features and an additional partial surface region without the cited properties—should remain outside of consideration.

"Visible" in the context of the invention means that there is a direct connecting line between stated points or areas that does not travel at least in segments through at least one medium absorbing x-ray radiation.

The design of the backscatter electron trap according to the invention prevents electrons backscattering from the surface of the anode from directly (i.e. without additional scattering) striking the backscatter electron trap and generating x-ray radiation (extrafocal radiation) there upon impact, which x-ray radiation falls in the usable x-ray beam and thereby degrades the quality of the generated x-ray radiation and the image quality or, respectively, leads to an unnecessary radiation exposure for a patient. This applies particularly for extrafocal radiation that passes from the backscatter electron trap through the exit window in a direction of usable x-ray radiation, i.e. in a radiation direction present in the usable x-ray beam (usable x-ray). Extrafocal radiation of another radiation direction does in fact leave the x-ray beam at a defined distance from the x-ray tube, but possibly only at a distance that is past the examination or detector region of an x-ray detector in which the x-ray tube according to the invention is used. However, given typical x-ray devices for medical technology a detector clearance of at least 50 cm from the focal spot of the x-ray tube can be assumed, such that extrafocal radiation that exits from the usable x-ray beam beforehand at most slightly negatively affects the image quality. According to the invention, those surface regions or partial surface regions of the backscatter electron trap are therefore to be avoided that can be struck directly by backscattered electrons and are visible as considered from an arbitrary point in the x-ray beam outside of the x-ray tube at at least a 50 cm clearance from the focal spot.

The goal of the invention is also to avoid in the backscatter electron trap partial surface regions at which the backscattered electrons directly strike and can generate x-ray radiation upon impact, which x-ray radiation falls in the usable x-ray beam and exits from the x-ray tube along a direction of usable x-ray radiation. Usable x-ray radiation direction is any x-ray radiation direction occurring in the usable x-ray beam. If any extrafocal radiation with such a radiation direction is prevented, the x-ray detector can be located at an arbitrary distance from the focal spot without it being able to be directly struck by extrafocal radiation.

The x-ray tube according to the invention is suitable to generate an x-ray beam to examine an examination subject in an x-ray device, wherein the x-ray beam is detected by an x-ray detector of the x-ray device after the penetration of the examination subject. According to the invention, the backscatter electron trap of the x-ray tube advantageously has no partial surface region visible from the viewpoint of the x-ray detector which is also visible as considered from the focal spot of the x-ray tube.

In an embodiment of the invention the appertaining surface region of the backscatter electron trap has multiple first partial surface regions separated from one another that are at least partially visible as considered from an arbitrary point in the x-ray beam outside of the x-ray tube, which first partial surface regions are not visible as considered from an arbitrary point of the focal spot. At least two first partial surface regions separated from one another are thereby advantageously separated from one another by at least one second partial surface region that is not visible from an arbitrary point in the x-ray beam outside of the x-ray tube and from an arbitrary point of the focal spot. By this special design of the backscatter electron trap according to the invention it is possible that electrons backscattered from the focal spot at a defined (in particular relatively flat) angle relative to the anode strike the backscatter electron trap (and in particular at its edge region) and are absorbed there. The proportion of electrons captured by the backscatter electron trap is thereby increased.

In a preferred embodiment of the invention, each second partial surface region is aligned at least approximately orthogonal to a connecting line between the focal spot and the respective second partial surface region. The second partial surface regions are thus aligned towards the focal spot. Directly backscattered electrons thereby strike at least approximately orthogonally on the second partial surface regions. This increases the absorption rate of backscattered electrons and reduces repeat scattering.

DESCRIPTION OF THE PREFERRED EMBODIMENTS

Figure 1:
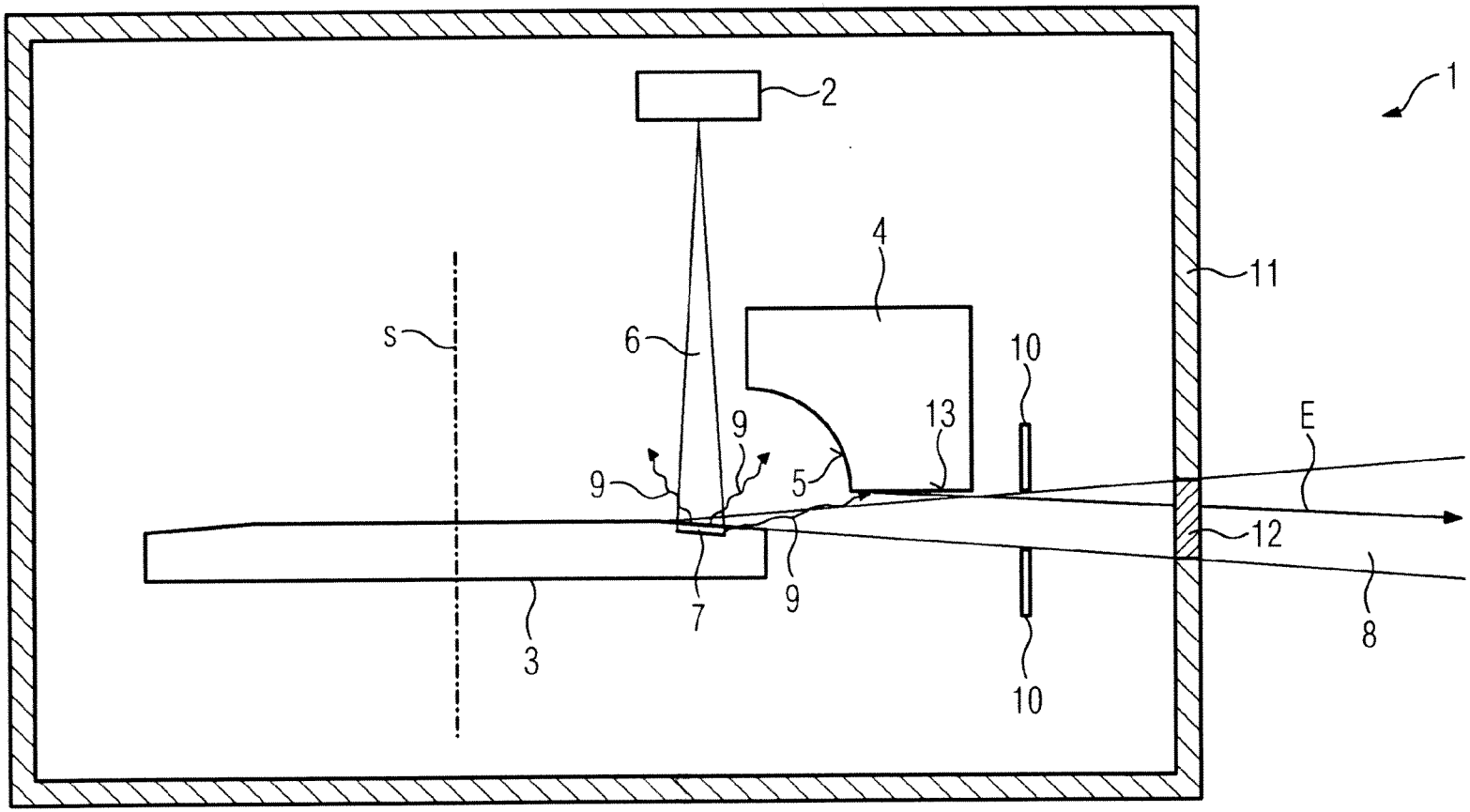
FIG 1 Prior art
FIG. 1 schematically illustrates an x-ray tube with a backscatter electron trap according to the prior art.

In a schematic, simplified representation, FIG. 1 shows an x-ray tube 1 according to the prior art. This comprises at least one cathode 2 to generate an electron beam 6, and an anode 3 at which the electron beam 6 strikes and there generates a focal spot 7. In the exemplary embodiment according to FIG. 1, the anode 3 is executed as a rotary anode that rotates around an axis S. In the focal spot 7, a portion of the energy present in the electrons is transduced into x-ray radiation, such that an x-ray beam 8 emanates from the focal spot 7. The x-ray beam 8 is limited by absorption elements 10. It exits from the x-ray tube 1 as usable x-ray radiation via an exit window 12 present in said x-ray tube 1.

During the operation of the x-ray tube 1, a portion of the electrons emitted by the cathode 2 are scattered back from the anode 3 upon striking the focal spot 7 there. A backscatter electron trap 4 is present in the x-ray tube 1 to capture such backscatter electrons 9. This normally has a concave surface 5 directed towards the focal spot 7, at which concave surface 5 a majority of the backscattered electrons impact and are absorbed there.

However, it cannot be prevented that x-ray radiation (extrafocal radiation) is also created upon the backscattered electrons striking the backscatter electron trap 4. Depending on the geometry of the arrangement, the extrafocal radiation that is created in the region of the concave surface 5 cannot leave the x-ray tube 1 through the exit window 12 in the direction of the usable x-ray radiation 8, and the quality of the usable x-ray radiation is thereby degraded. Otherwise it behaves as with the surface region 13 situated opposite x-ray beam 8 and facing towards this, which surface region 13 corresponds (from the point of view of FIG. 1) to an underside of the backscatter electron trap 4. This surface region 13 can be met on a direct path by electrons 9 backscattered from the focal spot 7. It is thereby possible that the backscatter electrons 9 generate x-ray radiation (extrafocal radiation) in the surface region 13 of the backscatter electron trap 4, which x-ray radiation leaves the x-ray tube 1 through the exit window 12 and falls in the usable x-ray radiation 8. This is indicated by the x-ray beam E (extrafocal radiation).

The extrafocal radiation is particularly interfering when it strikes an x-ray detector given use of the x-ray tube 1 in an x-ray device. This is in particular the case when the radiation direction of the extrafocal radiation coincides with a radiation direction of the usable x-ray radiation 8. Otherwise it would be possible that the generated extrafocal radiation again exits from the usable x-ray radiation before this strikes the x-ray detector. This extrafocal radiation would therefore be less disruptive.

Figure 2:
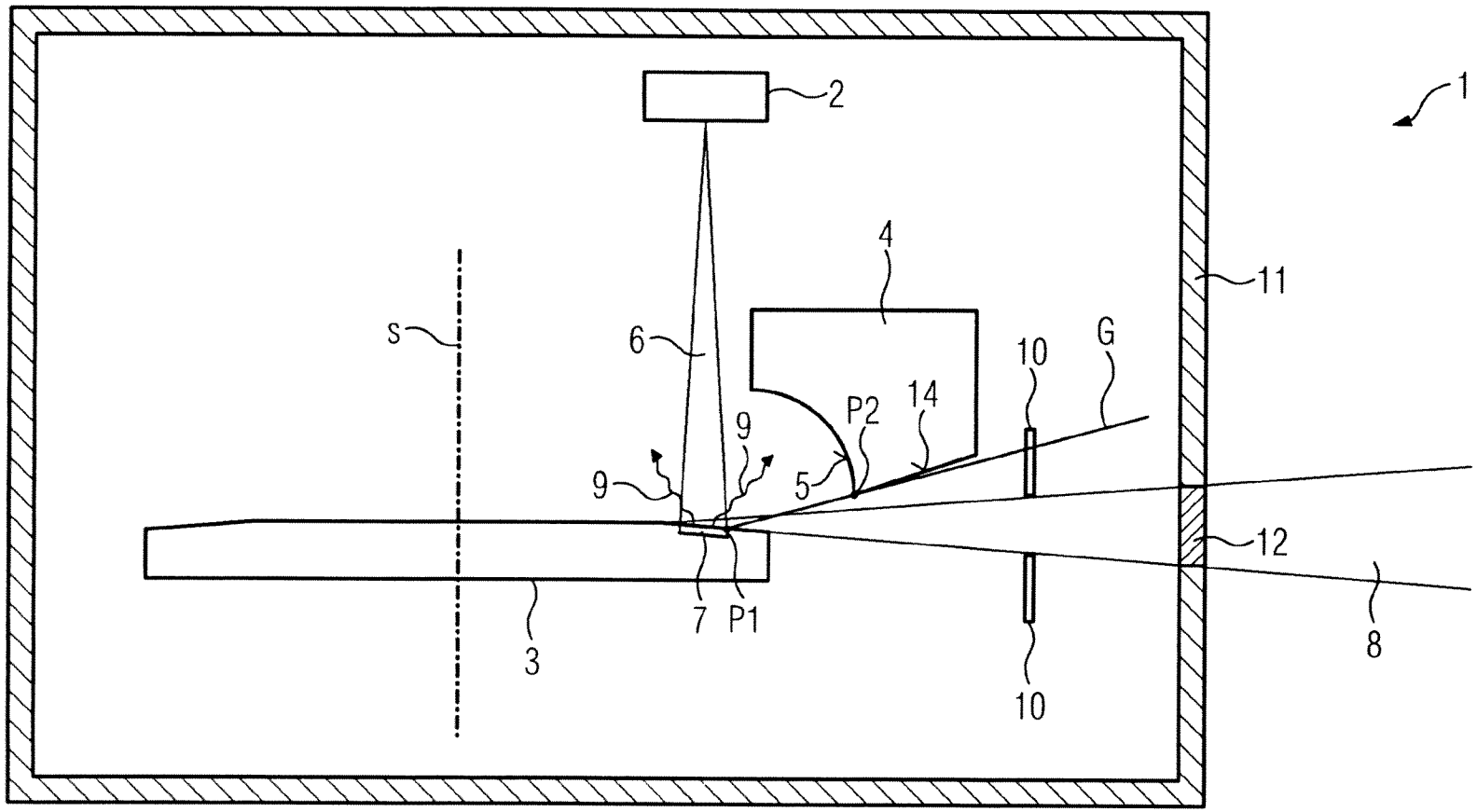
FIG. 2 schematically illustrates an x-ray tube having a first embodiment of a backscatter electron trap according to the present invention.

FIG. 2 shows a first exemplary embodiment of the invention. The x-ray tube shown there thereby coincides largely with the x-ray tube 1 from FIG. 1, which is why the same reference characters are also used. However, a significant difference exists in the special design of the backscatter electron trap 4. Its underside—thus the surface region 14 opposite the usable x-ray radiation 8 and facing towards this, which surface region 14 is at least partially also visible "from the outside"—is not visible here as viewed from an arbitrary point of the focal spot 7. Electrons 9 backscattered from the focal spot 7 can therefore not directly strike the surface region 14 since this is "shaded" by the surface region 5. In FIG. 2 this is additionally illustrated by a straight line G through a point P1 at the edge of the focal spot 7 and a point P2 lying on the connecting line of the surface regions 5 and 14, which connecting line does not cross the surface region 14. All regions of the backscatter electron trap 4 at which backscattered electrons 9 can impact directly (i.e. without additional scattering) are therefore "not visible" from the outside. This in particular applies for the surface region 5. "From the outside" means from an arbitrary point outside of the x-ray tube 1, viewed through the exit window 12 and past the absorption elements 10. "Visible" means that a direct connecting line between the appertaining points or, respectively, surfaces is not interrupted by an element absorbing x-ray radiation, for example the housing 11, the absorption element 10 or the backscatter electron trap 4. The concave surface region 5 is accordingly not visible "from the outside". It is in particular occluded by the surface 14 of the backscatter electron trap 4.

A more refined approach can be reasonable given the rough differentiation between partial surface regions that are visible from the outside and those that are not visible from the outside. An interfering extrafocal radiation can emanate from a partial surface region that is visible as considered from a point outside of the x-ray tube 1 and within the usable x-ray beam 8. Moreover, in particular those partial surface regions are relevant that are visible from a point within the usable x-ray beam 8 with at least 50 cm clearance from the focal spot 7. In particular, given these partial surface regions there exists the risk that extrafocal radiation undesirably arrives at an x-ray detector, since the distance between the focal spot and an x-ray detector is conventionally greater than 50 cm.

Furthermore, those surface regions are to be avoided that are visible as viewed both from the focal spot 7 and from a point within the usable beam 8 and counter to a radiation direction occurring in the x-ray beam 8. An interfering extrafocal radiation can always emanate from such partial surface regions, independent of the distance between the focal spot 7 and the radiation detector.

Moreover, those partial surface regions are naturally to be avoided that are visible as considered both from the focal spot 7 and from a point of the x-ray detector. In this case, the x-ray detector will always be struck by extrafocal radiation.

Figure 3:
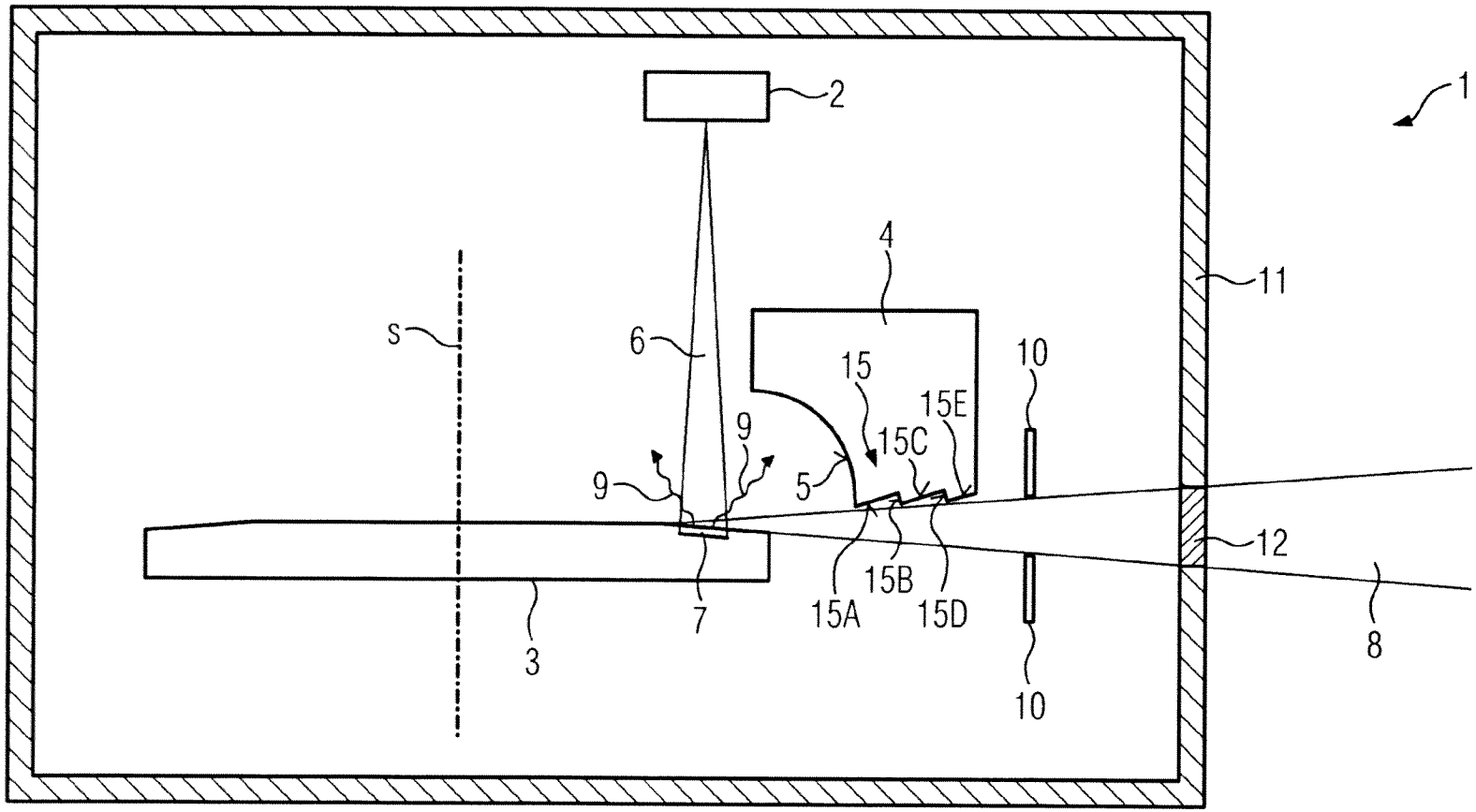
FIG. 3 schematically illustrates an x-ray tube having a second embodiment of a backscatter electron trap according to the present invention.

FIG. 3 shows an additional exemplary embodiment of the invention. In this, in the backscatter electron trap 4 a surface region 15 opposite the x-ray beam 8 and facing towards this is formed in profile. The profiling is thereby such that two different types of partial surface regions of the surface region 15 are created. On the one hand, these are the partial surface regions 15A, 15C and 15E. Although these are at least partially visible from the outside, they are not visible as considered from the focal spot 7. Backscattered electrons 8 can therefore not directly strike these partial surface regions. On the other hand, the partial surface regions 15B and 15D are located between the partial surface regions 15A, 15C and 15E. These are characterized in that they are in fact visible from the focal spot 7 and therefore can absorb backscattered electrons 9. However, they are not visible from the outside, such that extrafocal radiation created upon absorption cannot arrive outside of the x-ray tube 1 in the usable x-ray beam 8. In order to be able to absorb the backscattered electrons 9 as well as possible, the partial surface regions 15B and 15D are advantageously respectively aligned optimally orthogonal to a connecting line between the respective partial surface regions 15B and 15D and the focal spot 7.

Figure 4:
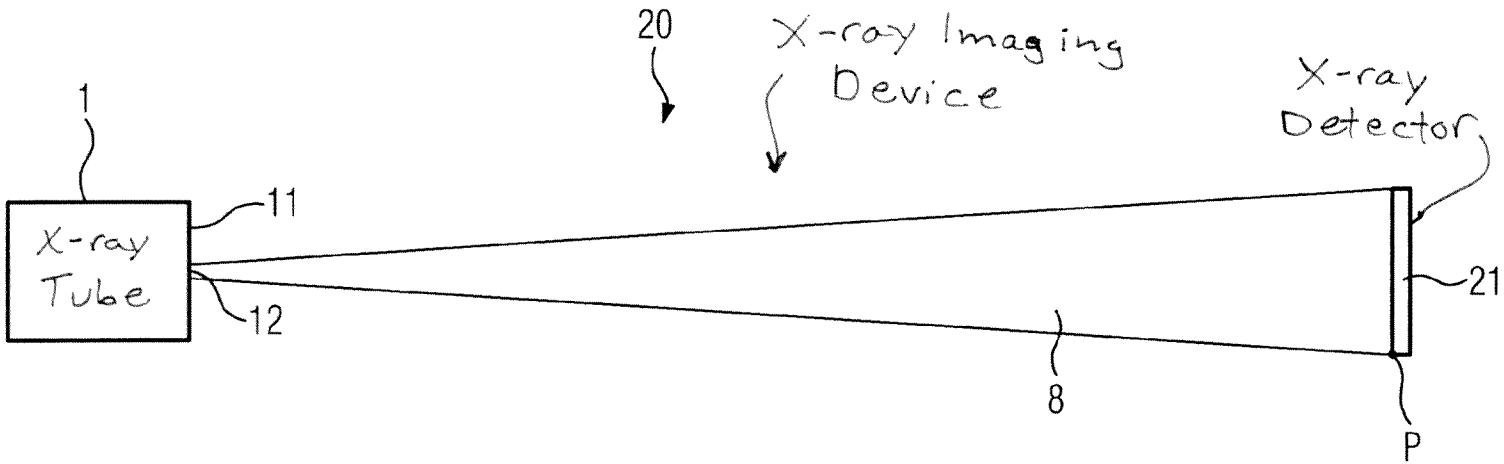
FIG. 4 schematically illustrates an x-ray imaging apparatus having an x-ray tube according to the invention, and an x-ray detector.

FIG. 4 shows an x-ray imaging device 20 with an x-ray tube 1 according to the invention, with a housing 11 as well as an exit window 12 and an x-ray detector 21 spaced apart from the x-ray tube 1. The usable x-ray beam 8 generated by the x-ray tube 1 thereby strikes the x-ray detector 21, possibly after penetrating an examination subject. The shown x-ray imaging device 20 can be a component of a computer tomograph (CT), for example. The distance between the x-ray tube 1 and the detector 21 then amounts to 100 cm, for example. Internally, the x-ray tube 1 is designed as in the exemplary embodiments according to FIGS. 2 and 3. Therefore, all surface regions or, respectively, partial surface regions of the backscatter electron trap 4 that are visible from the point of view of focal spot 7 are not visible from the point of view of the point P, even when considered from the disadvantageous viewing angle (namely from the point of view of point P on the surface of the x-ray detector 21). Extrafocal radiation emanating from directly backscattering electrons 9 can therefore not arrive at the x-ray detector 21.

Although modifications and changes may be suggested by those skilled in the art, it is the intention of the inventors to embody within the patent warranted heron all changes and modifications as reasonably and properly come within the scope of their contribution to the art.

We claim as our invention:

1. An x-ray tube comprising:

an evacuated housing;

a cathode in said housing that generates an electron beam in said housing;

an anode in said housing that is struck by said electron beam at a focal spot on said anode, said electron beam, upon striking said anode at said focal spot, causing emission of an x-ray beam from said anode and producing backscatter electrons that are backscattered from said anode;

said housing having a beam exit window therein through which said x-ray beam exits said housing to an exterior of said housing; and a non-electrified backscatter electron trap situated in said housing entirely between said electron beam and said x-ray beam, said backscatter electron trap being formed as a unitary, non-annular trap body that is mechanically separate from said anode, said trap body having a plurality of surfaces connected to each other and that are not connected to any surface of said anode, and that give said trap body a non-annular electron trap geometry that causes said backscatter electron trap to capture said backscattered electrons solely by said electron trap geometry, said trap body including a surface that faces said x-ray beam in said housing, said surface that faces said x-ray beam in said housing being located, and having a surface configuration, that makes no portion of said surface facing said x-ray beam in said housing intersect a direct line between an arbitrary point in said x-ray beam at an exterior of said housing and an arbitrary point at said focal spot.

2. An x-ray tube as claimed in claim 1 wherein said anode is a rotary anode mounted for rotation in said housing.

3. An x-ray device to generate x-ray images of an examination subject, said x-ray device comprising:

an x-ray tube comprising an evacuated housing, a cathode in said housing that generates an electron beam in said housing, an anode in said housing that is struck by said electron beam at a focal spot on said anode, said electron beam, upon striking said anode at said focal spot, causing emission of an x-ray beam from said anode and producing backscatter electrons that are backscattered from said anode, said housing having a beam exit window therein through which said x-ray beam exits said housing to an exterior of said housing, and a non-electrified backscatter electron trap situated in said housing entirely between said electron beam and said x-ray beam, said backscatter electron trap being formed as a unitary, non-annular trap body that is mechanically separate from said anode, said trap body having a plurality of surfaces connected to each other and that are not connected to any surface of said anode, and that give said trap body an electron trap geometry that causes said backscatter electron trap to capture said backscattered electrons solely by said electron trap geometry, said plurality of surfaces including a surface that faces said x-ray beam in said housing, said surface that faces said x-ray beam in said housing being located, and having a surface configuration, that makes no portion of said surface facing said x-ray beam in said housing intersect a direct line between an arbitrary point in said x-ray beam at an exterior of said housing and an arbitrary point at said focal spot; and a radiation detector located in a path of said x-ray beam outside of said housing that is struck by said x-ray beam.

4. An x-ray device as claimed in claim 3 wherein said anode is a rotary anode mounted for rotation in said housing.

5. An x-ray tube comprising:

an evacuated housing;

a cathode in said housing that generates an electron beam in said housing;

an anode in said housing that is struck by said electron beam at a focal spot on said anode, said electron beam, upon striking said anode at said focal spot, causing emission of an x-ray beam from said anode and producing backscatter electrons that are backscattered from said anode;

said housing having a beam exit window therein through which said x-ray beam exits said housing to an exterior of said housing; and a non-electrified backscatter electron trap situated in said housing entirely between said electron beam and said x-ray beam, said backscatter electron trap being formed as a unitary, non-annular trap body that is mechanically separate from said anode, said trap body having a plurality of surfaces connected to each other and that are not connected to any surface of said anode, and that give said trap body a non-annular electron trap geometry that causes said backscatter electron trap to capture said backscattered electrons solely by said electron trap geometry, said plurality of surfaces including a surface that faces said x-ray beam in said housing, said surface that faces said x-ray beam in said housing being located, and having a surface configuration, so that no straight unimpeded line of sight from an arbitrary point in said x-ray beam at an exterior of said housing intersects a first part of said surface that faces said x-ray beam and no straight line of sight from an arbitrary point at said focal spot intersects a second part of said surface that faces said x-ray beam, and so that no portion of said surface facing said x-ray beam in said housing intersects a direct line between an arbitrary point in said x-ray beam at an exterior of said housing and an arbitrary point at said focal spot.

6. An x-ray device as claimed in claim 5 wherein said anode is a rotary anode mounted for rotation in said housing.

7. An x-ray device to generate x-ray images of an examination subject, said x-ray device comprising:

an x-ray tube comprising an evacuated housing, a cathode in said housing that generates an electron beam in said housing, an anode in said housing that is struck by said electron beam at a focal spot on said anode, said electron beam, upon striking said anode at said focal spot, causing emission of an x-ray beam from said anode and producing backscatter electrons that are backscattered from said anode, said housing having a beam exit window therein through which said x-ray beam exits said housing to an exterior of said housing, and a non-electrified backscatter electron trap situated in said housing entirely between said electron beam and said x-ray beam, said backscatter electron trap being formed as a unitary, non-annular trap body that is mechanically separate from said anode, said trap body having a plurality of surfaces connected to each other and that are not connected to any surface of said anode, and that give said trap body a non-annular electron trap geometry that causes said backscatter electron trap to capture said backscattered electrons solely by said electron trap geometry, said plurality of surfaces including a surface that faces said x-ray beam in said housing, said surface that faces said x-ray beam in said housing being located, and having a surface configuration, so that no straight unimpeded line of sight from an arbitrary point in said x-ray beam at an exterior of said housing intersects a first part of said surface that faces said x-ray beam and no straight line of sight from an arbitrary point at said focal spot intersects a second part of said surface that faces said x-ray beam, and so that no portion of said surface facing said x-ray beam in said housing intersects a direct line between an arbitrary point in said x-ray beam at an exterior of said housing and an arbitrary point at said focal spot; and a radiation detector located in a path of said x-ray beam outside of said housing that is struck by said x-ray beam.

8. An x-ray device as claimed in claim 7 wherein said anode is a rotary anode mounted for rotation in said housing.

* * * * *